US010081464B2

(12) United States Patent
Krautkrämer

(10) Patent No.: US 10,081,464 B2
(45) Date of Patent: Sep. 25, 2018

(54) VENTING CAP FOR LIQUID CONTAINERS

(71) Applicant: BERICAP Holding GmbH, Budenheim (DE)

(72) Inventor: Günter Krautkrämer, Budenheim (DE)

(73) Assignee: BERICAP HOLDING GMBH, Budenheim (DE)

( * ) Notice: Subject to any disclaimer, the term of this patent is extended or adjusted under 35 U.S.C. 154(b) by 18 days.

(21) Appl. No.: 15/187,450

(22) Filed: Jun. 20, 2016

(65) Prior Publication Data

US 2017/0313480 A1 Nov. 2, 2017

(30) Foreign Application Priority Data

Apr. 27, 2016 (DE) ..... 20 2016 102 235 U

(51) Int. Cl.

| | |
|---|---|
| ***B65D 51/16*** | (2006.01) |
| ***B65D 47/32*** | (2006.01) |
| ***B65D 47/12*** | (2006.01) |
| ***B65D 41/34*** | (2006.01) |

(52) U.S. Cl.

CPC ..... *B65D 47/32* (2013.01); *B65D 41/3409* (2013.01); *B65D 47/122* (2013.01); *B65D 51/1688* (2013.01); *B65D 2205/02* (2013.01)

(58) Field of Classification Search

CPC ..... B65D 2205/00; B65D 51/16; B65D 51/1661; B65D 51/1688; B65D 41/3428; B65D 41/045; B65D 41/0471; B65D 41/3409; B65D 47/32

USPC ..... 222/397, 521, 520, 525, 482; 215/307; 220/366.1

See application file for complete search history.

(56) References Cited

U.S. PATENT DOCUMENTS

| | | | | |
|---|---|---|---|---|
| 1,548,459 | A * | 8/1925 | Hammer | B65D 41/04 215/330 |
| 1,784,089 | A * | 12/1930 | Carr | B65D 41/0485 215/295 |
| 3,927,798 | A * | 12/1975 | Loomis | B65D 51/1622 220/303 |
| 4,427,126 | A * | 1/1984 | Ostrowsky | B65D 41/045 215/307 |
| 4,747,502 | A * | 5/1988 | Luenser | B65D 41/045 215/307 |

(Continued)

FOREIGN PATENT DOCUMENTS

| | | |
|---|---|---|
| EP | 0568228 | 11/1993 |
| EP | 2208684 | 7/2010 |
| WO | 2009023102 | 2/2009 |

*Primary Examiner* — Charles P Cheyney

(74) *Attorney, Agent, or Firm* — Marsh Fischmann & Breyfogle LLP; Jonathon A. Szumny

(57) ABSTRACT

The present invention concerns a venting cap for liquid containers which besides a pouring opening also has a venting opening with a venting spigot provided with a corresponding venting cap. The venting cap has a closed head plate and a cap skirt which extends downwardly from the head plate and has at least one cylindrical portion having a female thread, wherein above the female thread the cap skirt has a venting portion at which there are provided at a spacing relative to the head plate retaining lugs which extend radially inwardly and define a free inside radius which is smaller than the inside radius of the thread.

16 Claims, 5 Drawing Sheets

(56) References Cited

U.S. PATENT DOCUMENTS

| | | | | | |
|---|---|---|---|---|---|
| 4,997,097 | A * | 3/1991 | Krautkramer | B65D 51/1661 | 215/252 |
| 5,004,112 | A * | 4/1991 | McBride | B65D 41/3423 | 215/252 |
| 6,089,390 | A * | 7/2000 | Druitt | B65D 41/3447 | 215/252 |
| 6,491,175 | B1 * | 12/2002 | Taha | B29C 45/262 | 215/252 |
| 7,419,066 | B1 * | 9/2008 | Ewers | B65D 51/1688 | 215/309 |
| 8,453,866 | B2 * | 6/2013 | Kamath | B65D 1/0246 | 215/329 |
| 2003/0098285 | A1 * | 5/2003 | Gregory | B65D 41/045 | 215/252 |
| 2005/0139621 | A1 * | 6/2005 | Foster | B65D 41/0428 | 222/521 |
| 2009/0184082 | A1 * | 7/2009 | Antier | B65D 41/045 | 215/216 |

* cited by examiner

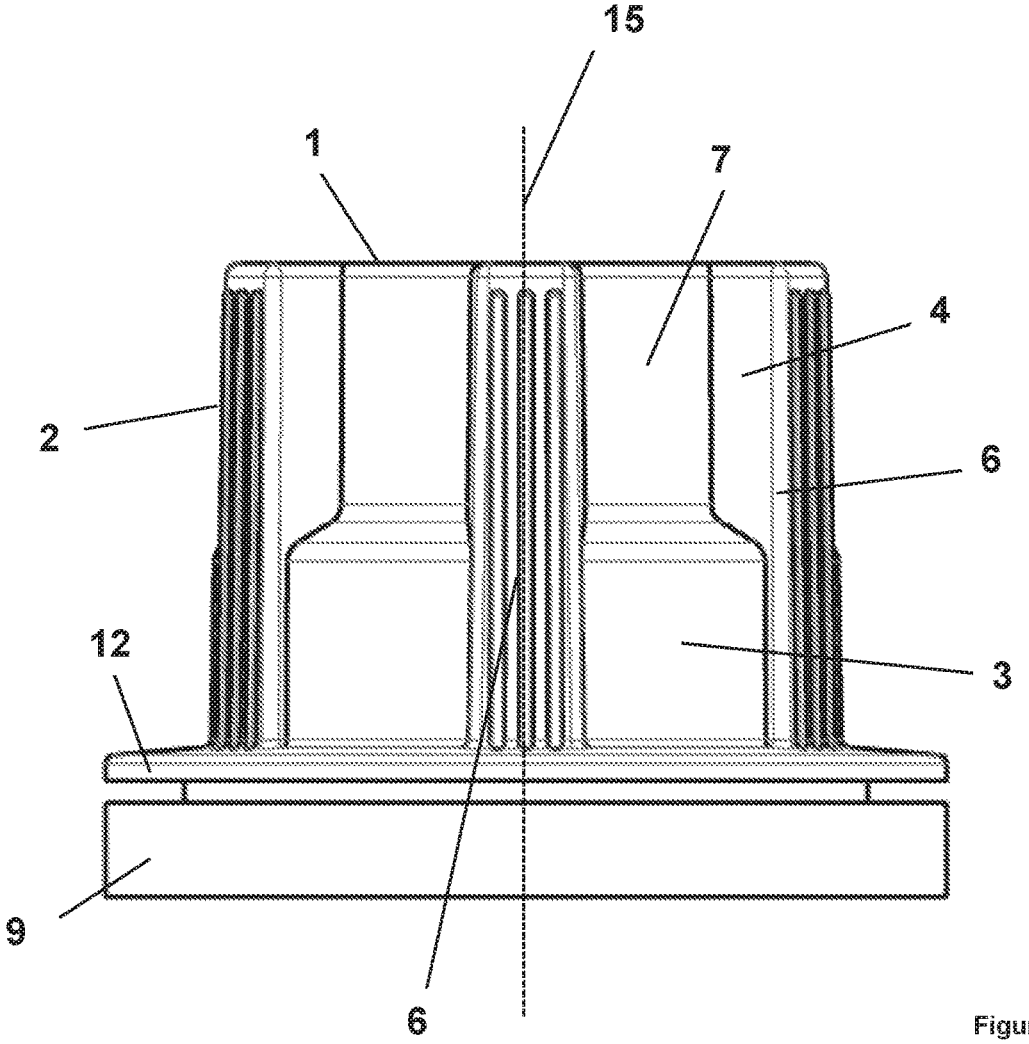
Figure 1a
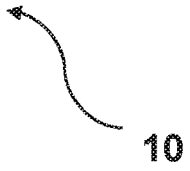

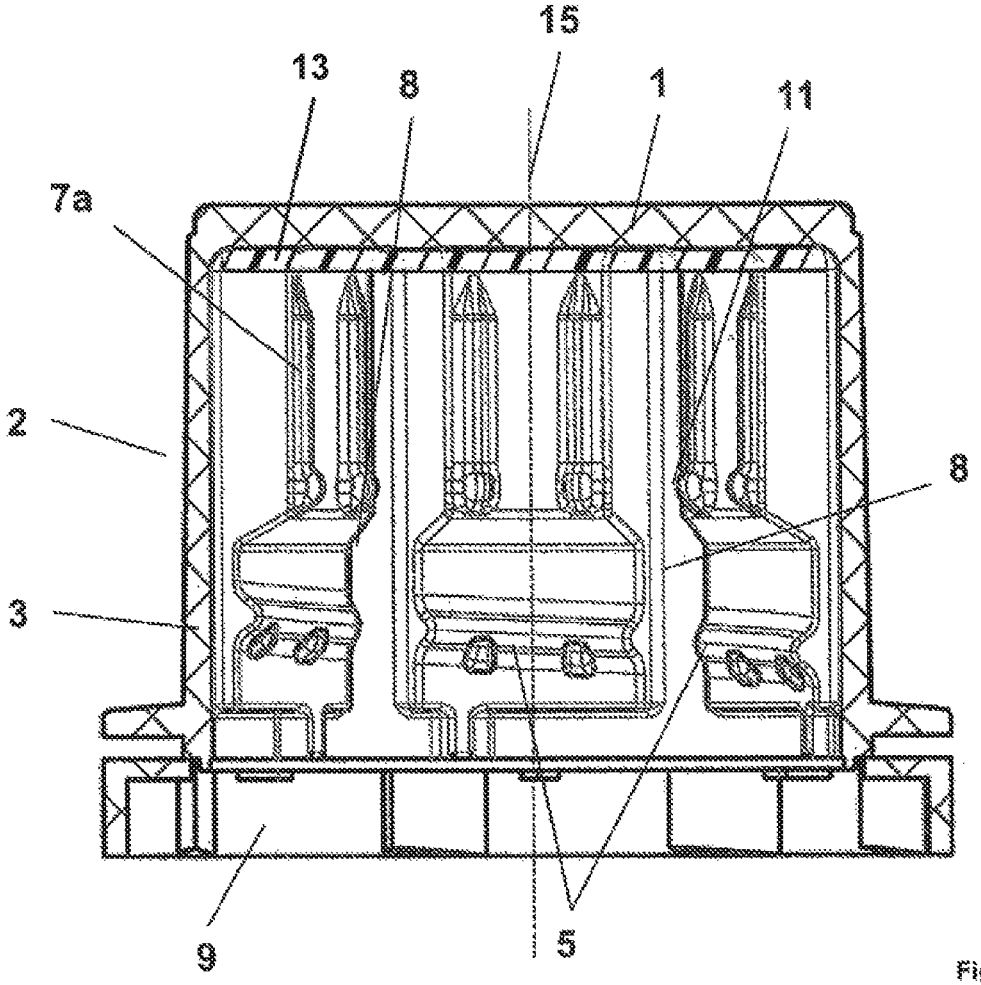
Figure 1b
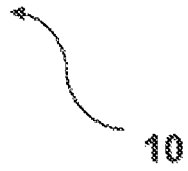

VENTING CAP FOR LIQUID CONTAINERS

BACKGROUND

1. Field of the Invention

The present invention relates to venting caps for liquid containers.

2. Relevant Background

Venting openings on containers, that are separate from a pouring opening, are provided to prevent a liquid in the container from spasmodically issuing when pouring the liquid out of the container. The spasmodic issue or "glugging" is related to temporary blockage of the cross-section of the pouring opening by the liquid as it issues, whereby a reduced pressure occurs in the container when pouring out the liquid, and that reduced pressure then leads to temporary stoppage or retardation of the flow of liquid out of the container opening whereby the container opening is in part cleared again and air can enter to compensate for the reduced pressure. That surge in discharge of liquid on the one hand considerably slows down the pouring operation and on the other hand frequently also leads to spillage of the liquid beside an opening into which the liquid is intended to be poured.

Pouring openings are already known in the state of the art, which have integrated venting devices, for example in the form of a separate passage of small cross-section. These however are not sufficiently effective if the liquid is of a relatively high viscosity beyond 50 cp up to for example about 1000 cp (1 cp (centipoise)=1 mPas (millipascal second)).

In particular, containers for more highly viscous liquids which are typically also of a volume of more than 5 l (for example 20 or 30 liters) therefore besides a pouring opening also have a separate venting spigot forming a venting opening. The present invention relates to the venting cap intended for such a venting spigot and also a corresponding container equipped with such a cap.

SUMMARY

In this respect the venting opening of such a container is formed by a venting spigot having a male thread on to which the venting cap can be screwed.

If liquid, for example highly viscous hydraulic oil, is to be poured out of such a container, then not only is the closure cap removed from the pouring opening of the container but the venting cap is also released. In that situation, however, the venting cap is not completely removed from the venting spigot but is only released from the thread to such an extent that the female thread of the venting cap is disposed above the male thread of a venting spigot.

Inwardly directed retaining lugs on the venting cap however engage behind an outwardly projecting edge of a neck of the venting spigot and thus prevent the venting cap from being completely released from the venting spigot. Known venting caps according to the state of the art also have openings in the cap skirt near the head plate thereof, which openings can also extend into the outer edge region of the head plate. The head plate or sealing elements at the inside of the head plate come into sealing engagement with the end of the venting spigot in the closed condition of the cap and thus prevent ingress of air from the environment. If however the venting cap is released so that the threads of the cap and the venting spigot are no longer in engagement then the opening of the venting spigot is at a spacing relative to the head plate of the venting cap and is thus accessible and air can pass into the interior of the cap and from there directly into the venting spigot through the venting openings provided laterally in the cap skirt or also the cap plate.

The venting spigot is typically disposed in an upper region of the container (for example an oil can which can be of a volume of 20 l and more in the case of hydraulic oil for large machines), which during pouring of the liquid is on the one hand sufficiently remote from the pouring opening and in the condition of the container of being tilted for the pouring operation is at a higher level in relation to the pouring opening so that the venting spigot is generally in communication with a hollow space in the upper region of the container, into which then the air can subsequently flow. That avoids the occurrence of a reduced pressure in the container so that the liquid can be poured out continuously in a uniform flow free from gushing surge.

The pouring operation is considerably speeded up thereby. That is advantageous in particular in situations of use in which a very large amount of liquid is to be poured out of a plurality of corresponding containers into a storage tank of a machine. Corresponding machines which have large storage tanks for hydraulic oil are used in particular in underground working and in mining and tunnel construction.

Upon a change in the hydraulic oil for example a number of large cans involving volumes of between 10 and 30 l have to be emptied into suitable storage tanks.

Because of the very low viscosity of gas or ambient air which flows into the container the venting openings can be substantially smaller in relation to the pouring opening in order nonetheless to provide for a sufficient gas volume to flow into the container, avoiding the occurrence of a reduced pressure in the container.

It will be noted however that the conventional venting caps suffer from the disadvantage that there is practically a direct access from the venting openings in the venting cap to the opening of the venting spigot, which in particular in working environments in which swirled-up dust and other foreign particles (threads, chips and so forth) are present in the ambient air, that dirt or dust can also easily penetrate into the interior of the container and thus contaminate the liquid in the container. In worst-case individual scenarios in that respect larger dirt particles or also smaller stones which are swirled up can penetrate into the interior of the container and lead to complications in the machine filled with the liquid.

Therefore the object of the present invention is to provide a venting cap in which the danger of the ingress of coarse dirt and dust, in particular relatively large dirt particles, is better prevented than is possible with the conventional venting cap.

That object is attained in that the cap skirt is closed along its entire periphery and the inside surface of the cap skirt has venting passages in the form of elongate recesses in the inside wall of the cap skirt, which extend axially from the venting portion above the retaining lugs and through the female thread in the direction of the lower free edge of the cap.

If such a cap is released from the male thread of a venting spigot like also the conventional venting caps and is still held with play on the venting spigot by the retaining lugs then air or ambient gas can flow into the cap only at the lower open edge of the venting cap while pouring out liquid and pass along the venting passages past the thread into the venting portion and from there into the opening of the venting spigot. By virtue of that roundabout path that the air must follow to pass into the venting spigot in particular larger dirt particles and also coarser dust particles in the environment impact against the edge of the venting spigot and at the venting cap and the venting air which is thus substantially freed of dirt and dust can pass into the venting spigot of the container through the venting passages.

In an embodiment of the invention on its inside the venting portion of the cap has retaining portions which are spaced from each other in the peripheral direction and which extend axially and which define an inside surface of a radius which is smaller than the nominal radius of the female thread and at which the retaining lugs are arranged, the venting passages extending between adjacent retaining portions.

The retaining portions serve in particular to accommodate the retaining lugs which define an internal radius which is smaller than the radius of an outwardly projecting edge at the upper edge of a venting spigot. As on the other hand the cap has to be fitted on to the venting spigot and screwed with the male thread to the venting spigot the female thread of the cap must necessarily be of a diameter or a core radius which is at least as large as the outside radius of a projecting edge on the neck of a venting spigot. The female thread of the cap can thus be moved past the edge of the neck of a venting spigot and brought into engagement with the male thread of the venting spigot while the retaining lugs are of such a size that they admittedly define an inside radius smaller than the outside radius of the projecting edge of the neck on the venting spigot, but which on the other hand is of such a size that the lugs can be moved past each other with elastic deformation of the neck edge and/or the lugs and the retaining portion so that the lugs then engage behind the edge of the neck of the venting spigot and secure the venting cap to the venting spigot when the threads of the cap skirt and the venting spigot are released from each other. Viewed in that way the cap is mounted captively to the venting spigot, but sealing elements at the head plate of the cap and venting spigot can be moved away from each other and held in that condition so that the opening of the venting spigot is clear at a spacing relative to the head plate or seal of the cap.

The retaining portions which form a part of the peripheral skirt surface in the region of the venting portion of the venting cap can therefore define an inside radius which is smaller than the nominal diameter of the thread of the cap but nonetheless larger than the outwardly projecting edge at the neck of the venting spigot or equal to that radius.

A smaller diameter for the retaining portion contributes to better stability of the retaining lugs and thus also to better securing of the venting cap to a venting spigot of a container.

Depending on how large the radius of the neck of a venting spigot and the associated projecting neck edge is, the radius defined by the retaining portions can also be smaller than the core radius of the female thread of the cap if the core diameter of the female thread is identified by "r", the free inside radius defined by the retaining lugs is identified by "r1", the radius defined by the retaining portion is identified by "r2" and the nominal diameter of the female thread (radius defined by the bottom of the thread) is identified by "R", then the following relationship applies:

$$r1<r2\leq r<R.$$

In an embodiment the retaining portions at their edges have axially extending reinforcing ribs in the peripheral direction, whose lower ends are thickened to form retaining lugs. In this configuration the radius r2 of the retaining portions is defined by the radius of the internal opening remaining between the ribs.

With incorporation of the corresponding measurements at the venting spigot, wherein the core diameter of the male thread of the venting spigot is identified by r4, the outside radius of the neck of the venting spigot is identified by r3 and the radius of the retaining edge of the venting spigot is identified by r5, the foregoing relationship can also be supplemented by the following conditions:

$$r3\leq r1<r5\leq r2\leq r4\leq r<R. \qquad r_2$$

In general the radius of the retaining portions should be at least 30%, preferably at least 70%, of the core radius of the female thread because otherwise the radius of the neck also has to be correspondingly small and reduces the intake cross-section for the venting action.

In an embodiment on its outside the cap skirt has a plurality of axially extending and at the same time radially outwardly extending ribs, on the inside of which the venting passages are provided. The outwardly projecting ribs of the cap skirt are hollow when thus viewed from the interior. In other words the inside surface of the cap skirt has portions which project radially inwardly and are set back outwardly alternately in the peripheral direction, wherein the outwardly extending portions form the venting passages. If in a similar fashion the outside has corresponding radially projecting and set-back portions that gives the foregoing variant with ribs at the outer periphery of the venting cap, which are hollow and thus form venting passages on their inside.

The nominal radius of the female thread of such a venting cap is desirably in the range of between 5 and 15 mm (diameter between 10 and 30 mm).

Such a cross-section is generally sufficient, even with less viscous liquids which flow out correspondingly more quickly, to ensure sufficiently rapid venting after release of the venting cap, if the neck of the venting opening is not reduced to less than half the nominal radius of the female thread.

It is desirable if, with a plurality of venting passages, the minimum cross-section of each individual venting passage is throughout at least 2 $mm^2$. In other words, with a width of at least 2 mm, each venting passage should be of a depth of at least 1 mm, as also measured from the bottom of the female thread (that is to say from the nominal radius).

Preferably the minimum cross-section of each venting passage is at least 5 $mm^2$.

The number of venting passages can typically be between 3 and 10, wherein the sum of the cross-sections of all venting passages should be at least 10 $mm^2$. In that case the cross-section of a venting passage above the female thread should be at least as large as in the region of the female thread. Desirably the venting passages extend to the lower edge of the cap skirt so that the ambient air or gases can pass directly into the venting passages at the lower edge of the cap. It will be appreciated that for example in the case of liquids which are not to come into contact with oxygen in the container, the venting cap can also be connected to a source or a volume of a different gas from ambient air (nitrogen, argon and so forth).

Moreover an anti-tamper band can be provided at the lower edge of the cap skirt and at an axial prolongation thereof.

Such an anti-tamper band is typically connected to the lower edge of the cap skirt by easily breakable bridges and is thus held fast to a venting spigot or a retaining device at the transition from a container wall to the venting spigot so that when the venting cap is undone, the female thread thereof being in engagement with the male thread of the venting spigot, the easily breakable bridges between the venting cap and the anti-tamper band tear and thereby indicate that the venting cap has already been released once.

That is important insofar as otherwise there would be the danger that the venting cap, after release of the thread engagement with its retaining lugs, is forced to move beyond the edge of the neck of the venting spigot and is completely removed in order for example to manipulate the container contents or to remove the liquid by way of the venting spigot. It will be appreciated that the main closure of the pouring opening in turn has suitable anti-tamper devices.

In addition at least one sealing element, for example a sealing disk, is provided on the inside of the head plate in an embodiment.

Such a sealing disk which preferably comprises elastic material is then brought into sealing engagement with the end of the neck by screwing the venting cap on to the thread of a venting spigot and thus prevents both the ingress of air and also the escape of liquid. In general the venting spigot, like also the corresponding pouring opening, is typically disposed at the top side of the respective container or at least in the proximity of the top side.

In an embodiment the radially outwardly disposed bottom of the venting passages is disposed over its entire axial length on a substantially constant radius around the axis of the cap, the axis being defined by the cylindrical portion of the cap. That permits a venting flow which is as undisturbed as possible. It will be noted however that the cap skirt does not necessarily have to be of an exactly cylindrical shape but can also be slightly conical. It will be appreciated that then too the venting passages or the bottom of such passages substantially follow that conical configuration of the cap skirt.

In regard to the container defined in the opening part of this specification the object of the invention is attained in that the venting spigot of such a container is provided with a cap as set forth in one of claims 1 through 16.

In an embodiment the neck of the venting spigot beneath its projecting edge is of an outside radius which at most is equal to the core radius of the male thread and preferably smaller than the core radius of the male thread of the venting spigot.

As already mentioned the neck of the venting spigot below its projecting edge should be of a sufficiently large outside radius which for example is between 70% and 90% of the core radius of the male thread of the venting spigot. The retaining lugs on the venting cap can in that case define a radius corresponding to the outside radius of the neck.

BRIEF DESCRIPTION OF THE DRAWINGS

Further advantages, features and possible uses of the present invention will be apparent from the description hereinafter of a preferred embodiment and the related Figures in which:

FIGS. 1*a-d* show various views of the closure cap according to the invention.

DETAILED DESCRIPTION

Figure 1C:
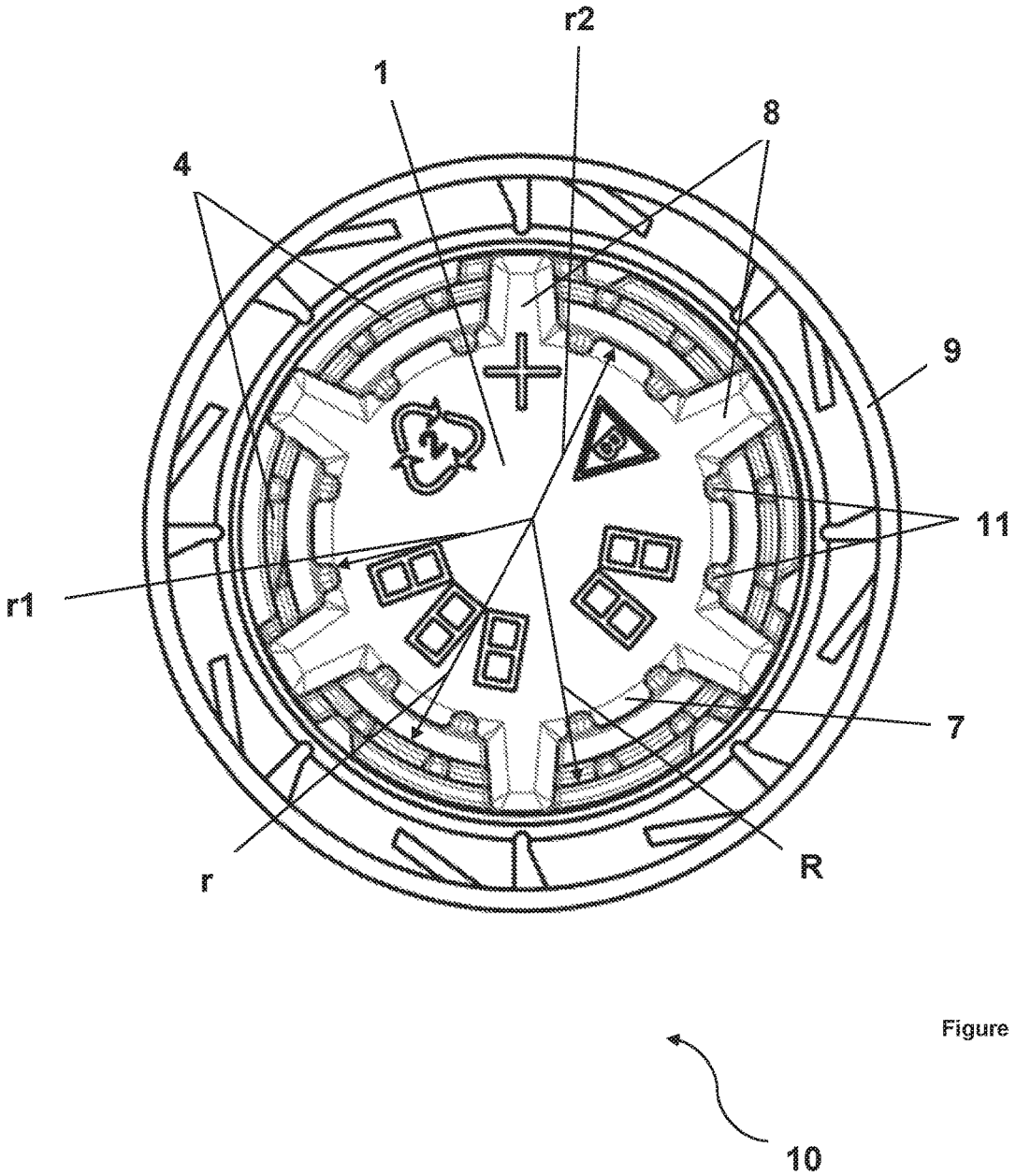

FIG. 1*a* shows a side view of a venting cap according to the invention. The venting cap 10 has a flat head plate 1 from which a markedly structured cap skirt 2 extends downwardly. The cap skirt 2 can be notionally divided in the axial direction into a thread portion 3 and a venting portion 4.

The cap skirt 2 also has a plurality of ribs 6 which extend over substantially the entire axial length of the cap skirt 2 and which project radially outwardly. The venting portion 4 has between the ribs 6 radially somewhat inwardly displaced skirt portions which are here referred to as "retaining portions" 7. In the region of the thread portion 3 in addition the cap skirt 2 is displaced somewhat radially inwardly between the ribs 6, but defines a larger diameter than in the region of the retaining portions 7.

FIG. 1*b* is a sectional view containing the axis 15 of the cap. It will be seen that the thread portion 3 has a female thread 5 comprising a plurality of segments separated from each other by venting passages 8. The venting passages 8 extend over the entire length of the inside of the cap skirt and in particular also into the venting portion 4 where the venting passages 8 are arranged alternately in the peripheral direction with retaining portions 7. At the lower end of the retaining portions 7, the edge region of which is also reinforced by axially extending reinforcing ribs 7*a*, it is possible to see radially inwardly projecting retaining lugs 11. In specific terms here the retaining lugs 11 are formed by thickened lower ends of reinforcing ribs 7*a*.

The reinforcing ribs do not extend entirely to the inside of the head plate 1 and can thus with their upper end faces hold a sealing disk which is arranged at the head plate and whose radius is larger than the radius defined by the reinforcing ribs 7*a*. In this case the spacing of the reinforcing ribs relative to the head plate 1 is matched to the thickness of the sealing disk.

Near its lower edge the cap skirt has a peripherally extending flange edge 12, wherein provided at the lower edge of the cap skirt 2 there is also a so-called anti-tamper band 9 which is connected to the edge of the cap skirt by way of easily breakable bridges and which prolongs the cap overall in the axial direction, the anti-tamper band 9 being of an outside diameter approximately corresponding to the outside diameter of the flange edge immediately above the anti-tamper band 9. The flange edge 12 is intended to prevent the tooth configurations on the inside of the anti-tamper band 9 being manipulated in order to release the cap 10 from the thread of a venting spigot without tearing the easily breakable connections between the cap skirt 2 and the anti-tamper band 9.

FIG. 1*c* shows a view from below into the open underside of the cap of FIG. 1*a*. Here too it is possible to see the female thread 5 which comprises individual leg segments and which is interrupted by the venting passages 8. The venting passages 8 are defined precisely where the ribs 6 are provided on the outside, that is to say they form a hollow space in the interior of the ribs. In the peripheral direction the width of the venting passages 8 is typically between 1 and 5 mm, preferably between about 2 and 3 mm, wherein the depth of the venting passages 8 in the venting portion 4 is greater than in the thread portion because the retaining portions 7 between the venting passages 8 in the region of the venting portion project radially further inwardly than the thread portion 3. The bottom of the venting passages 8 however is throughout radially outside the bottom of the female thread 5 and the bottom of the venting passages, over the axial length of those passages, is disposed substantially on the same radius. If the outside surfaces of the ribs 6 jointly define a conical surface involving a very small cone angle then the bottom of the venting passages 8 can also be disposed on a corresponding cone surface which is somewhat smaller in diameter.

Unlike the situation shown in FIG. 1*c* the radius r2 of the retaining portions 4 in the case of this embodiment is in precise terms not defined by the wall portions identified by reference 7 but by the reinforcing ribs 7*a* which however are only visible in FIG. 1*b*, being however concealed by the retaining lugs 11 in FIG. 1*c*. The radius r2 would thus be somewhat smaller than can be seen in FIG. 1*c*, but always still larger than the radius r1 of the retaining lugs 11.

Figure 1D:
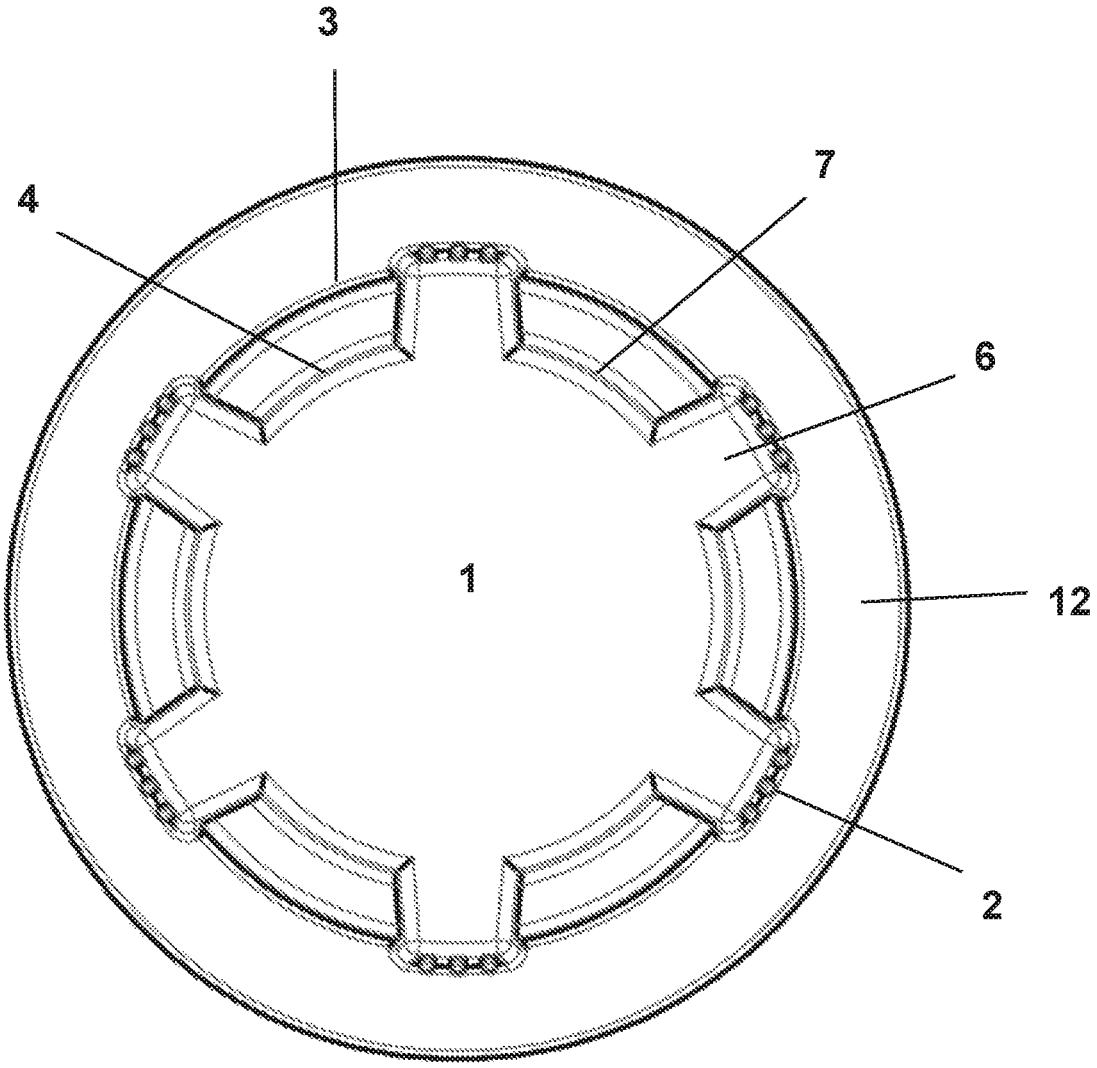

FIG. 1*d* shows a view on to the closure of FIG. 1*a* from above, looking on to the head plate 1. It will be seen that the head plate 1 is substantially a circular disk with star-shaped enlargements which are formed by the upper end faces of the ribs 6. Between the ribs 6 it is possible to see the retaining portions 7 defining the periphery of the central circular disk. It will also be seen that in the region of the retaining portions 7 the venting portion 4 is of a markedly smaller radius than the threaded portion 3 which has the female thread on its inside. This plan view also shows the flange edge 12 covering the top side of the anti-tamper band 9.

Figure 2:
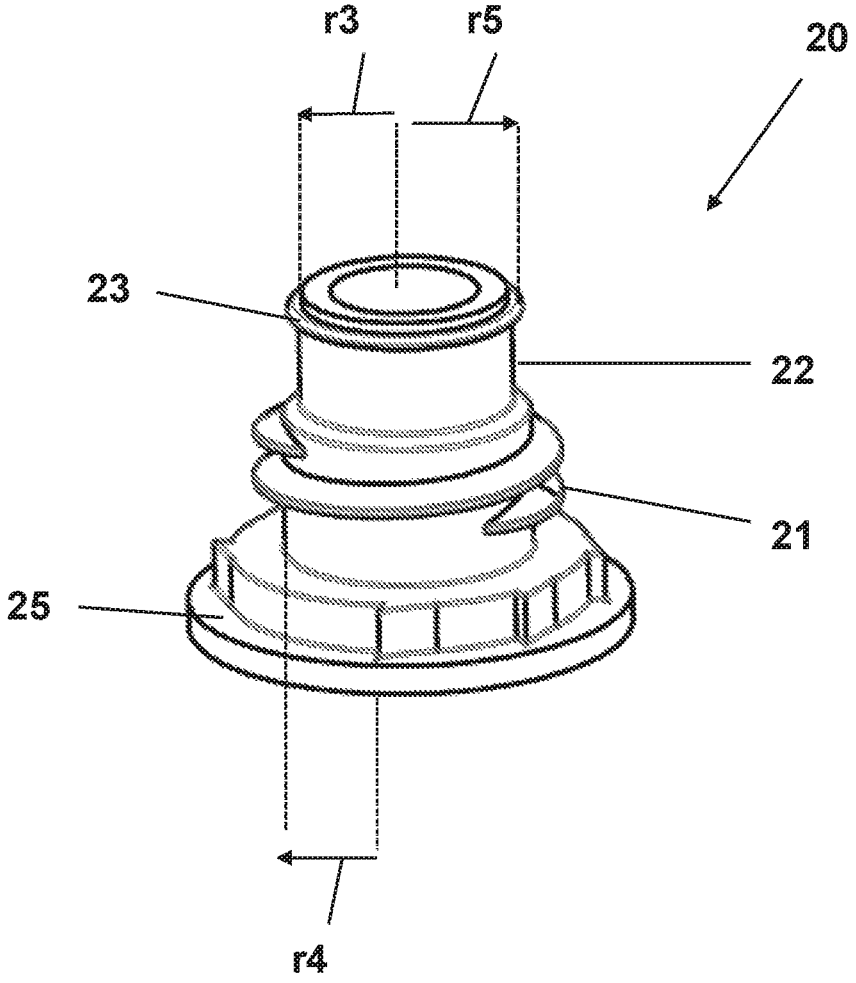
FIG. 2 shows a perspective view of a corresponding venting spigot on a container wall.

FIG. 2 shows a perspective view of a venting spigot 20 arranged at the upper wall 25 of a container (not shown in greater detail here). The venting spigot 20 comprises a lower portion 21 having a male thread and an upper neck 22 which has a projecting edge 23 in the proximity of its upper end. The outside diameter of the neck is identified by "r3" and the outside diameter of edge 23 is identified by "r5". The core diameter of the male thread 21 is identified by "r4". In use the venting cap 10 is fitted on to the venting spigot 20 and the retaining lugs 11 are pushed away over the projecting edge 23, the edge 23 and/or the lugs 11 or the retaining portions 7 being elastically deformed in that case so that the retaining lugs 11 can latch behind the edge 23 and are then only axially moveable in the region of the neck 22 between the thread 21 and the edge 23. When the retaining lugs 11 have passed the projecting edge 23, the female thread 5 can come into engagement with the male thread 21 and the venting cap can be screwed on to the thread 21. In that case the inside surface of the head plate 1 or a sealing disk arranged on that inside surface of the head plate come into sealing engagement with the upper end face of the neck 22. To open the venting spigot the cap 10 is unscrewed from the venting spigot 20 until the threads 21 and 5 are out of engagement, in which case however the retaining lugs 11 which still engage behind the edge 23 on the neck 22 prevent complete release of the venting cap from the venting spigot 20, even if forcible removal of the venting cap from the venting spigot still remains entirely possible. The retaining lugs 11 however prevent the cap 10 from being simply pulled off the venting spigot and in that way signal to the user that for venting purposes the cap only has to be and is only intended to be released from the thread engagement, but does not have to be and is not to be completely removed.

After release of the thread engagement the head plate 1 or its seal is at a spacing from the end of the neck 22 so that air can pass into the container by way of the passages 8 on the inside of the venting cap 10 and can flow from the passages 8 into the central opening of the container neck 22. The inflowing air equalizes a reduced pressure which otherwise occurs when pouring liquid out of the pouring opening of the container. As can be seen the venting cap 10 is completely closed outwardly, that is to say the head plate 1 and the cap skirt 2 form a closed unit to below the flange edge 12 and the lower edge of the cap skirt 2.

In use of the venting cap the anti-tamper band 9 is separated from the lower edge of the cap skirt 2 and (irrespective of the position of the anti-tamper band) air can flow past the lower edge of the cap skirt 2 for venting the container and through the passages 8 past the male thread 21 and the neck of the venting spigot 20 and enter the central opening of the neck 22. A direct straight-line path from the exterior through the openings in the cap skirt and into the central opening of the neck 22 is no longer possible as a result. The air or gas for venting purposes therefore necessarily has to follow a roundabout path which securely prevents at least relatively large dirt particles from being drawn in.

REFERENCE NUMERALS

1 head plate
2 cap skirt
3 thread portion
4 venting portion
5 female thread
6 rib(s)
7 retaining portion
7*a* reinforcing ribs
8 venting passages
9 anti-tamper band
10 venting cap
11 retaining lugs
12 flange edge
15 axis
20 venting spigot
21 lower portion/male thread
22 neck
23 projecting/protruding edge
25 upper wall of a container

What is claimed is:

1. A venting cap for liquid containers comprising:

a closed head plate (1) and a cap skirt (2) which extends downwardly from the head plate and has at least one cylindrical portion (3) having a female thread, wherein above the female thread (5) the cap skirt (2) has a venting portion (4) at which there are provided at a spacing relative to the head plate (1) retaining lugs (11) which extend radially inwardly and define a free inside radius (r) which is smaller than the inside radius (r) of the thread (5), characterised in that the cap skirt (2) is closed along an entire periphery of the cap skirt (2) and the inside surface of the cap skirt (2) has venting passages (8) in the form of elongate recesses in the inside wall of the cap skirt (2), which extend axially in and from the venting portion (4) above the retaining lugs (11) and through the female thread in the direction of the lower free edge of the cap;

wherein the inside of the venting portion (4) has retaining portions (7) disposed above the female thread, which are spaced from each other in the peripheral direction and which extend axially, the retaining portions further defining an inside surface of a radius (r2) which is smaller than the nominal radius (R) of the female thread and at which the retaining lugs (11) are arranged, the venting passages (8) extending between said retaining portions.

2. A venting cap for liquid containers as set forth in claim 1, characterized in that the radius of the retaining portions (7) is smaller than the core radius (r) of the female thread.

3. A venting cap for liquid containers as set forth in claim 2, characterized in that the radius (r2) of the retaining portions (7) is at least 30%, preferably at least 70%, of the core radius (r) of the female thread.

4. A venting cap for liquid containers as set forth in claim 1, characterized in that the radius (r2) of the retaining portions (7) is at least 30%, preferably at least 70%, of the core radius (r) of the female thread.

5. A venting cap for liquid containers as set forth in claim 1, characterized in that the outside of the cap skirt (2) has axially extending and radially outwardly extending ribs (6), on the inside of which the venting passages (8) are provided.

6. A venting cap for liquid containers as set forth in claim 1, characterized in that the inside surface of the cap skirt (2) has portions which project radially inwardly and are set back outwardly alternately in the peripheral direction, wherein the outwardly extending portions form the venting passages (8).

7. A venting cap for liquid containers as set forth in claim 1, characterized in that the nominal radius (R) of the female thread is between 10 and 30 mm.

8. A venting cap for liquid containers as set forth in claim 1, characterized in that the sum of the cross-sections of all venting passages (8) in the region of the female thread radially outside the nominal radius (R) of the female thread is at least 10 $mm^2$.

9. A venting cap for liquid containers as set forth in claim 1, characterized in that the minimum cross-section of each individual venting passage (8) is throughout at least 2 $mm^2$.

10. A venting cap for liquid containers as set forth in claim 1, characterized in that the cross-section of each venting passage (8) above the female thread (5) is at least as large as in the region of the female thread (5).

11. A venting cap for liquid containers as set forth in claim 1, characterized in that the venting passages extend to the lower edge of the cap skirt (2).

12. A venting cap for liquid containers as set forth in claim 1, characterized in that an anti-tamper band (9) is provided at the lower edge of the cap skirt (2) and as an axial prolongation thereof.

13. A venting cap for liquid containers as set forth claim 1, characterized in that the inside of the head plate (1) of the cap has at least one sealing element.

14. A venting cap for liquid containers as set forth in claim 1, characterized in that an axial length of the radially outwardly disposed bottom of the venting passages (8) is disposed over a substantially constant radius around an axis of the cap which is defined by the cylindrical portion of the cap.

15. A venting cap for liquid containers as set forth in claim 4, characterized in that the radius (r2) of the retaining portions (7) is at least 70% of the core radius (r) of the female thread.

16. A venting cap for liquid containers as set forth in claim 3, characterized in that the radius (r2) of the retaining portions (7) is at least 70% of the core radius (r) of the female thread.

* * * * *